US006459203B1

(12) United States Patent
Kim

(10) Patent No.: US 6,459,203 B1
(45) Date of Patent: Oct. 1, 2002

(54) LAMP APPARATUS FOR LIQUID CRYSTAL DISPLAY DEVICE

(75) Inventor: Kyoung Sub Kim, Kumi (KR)

(73) Assignee: LG.Philips LCD Co., Ltd., Seoul (KR)

( * ) Notice: Subject to any disclaimer, the term of this patent is extended or adjusted under 35 U.S.C. 154(b) by 0 days.

(21) Appl. No.: 09/729,165

(22) Filed: Dec. 5, 2000

(30) Foreign Application Priority Data

Jul. 20, 2000 (KR) ..... 00-41530

(51) Int. Cl.[7] ..... H01J 17/52

(52) U.S. Cl. ..... 315/56; 315/169.4; 349/70; 362/225

(58) Field of Search ..... 315/58, 57, 56, 315/246, 169.3, 169.4; 313/25, 281–285, 623; 349/65, 64, 70; 362/260, 262, 221, 225, 227, 217

(56) References Cited

U.S. PATENT DOCUMENTS 4,906,888 A * 3/1990 Dunn et al. ..... 313/285
5,288,249 A 2/1994 Fitzgerald ..... 439/612
5,519,289 A * 5/1996 Katyl et al. ..... 315/209 R
5,726,722 A * 3/1998 Uehara et al. ..... 315/209 R
5,796,382 A * 8/1998 Beeteson ..... 345/102
5,890,793 A * 4/1999 Stephens ..... 362/11
5,921,819 A 7/1999 Lee ..... 439/698
5,962,989 A * 10/1999 Baker ..... 315/294
6,075,320 A * 6/2000 Winsor ..... 313/493
6,203,172 B1 * 3/2001 Wanuch et al. ..... 362/225

FOREIGN PATENT DOCUMENTS

JP 08 069705 3/1996

* cited by examiner

*Primary Examiner*—Haissa Philogene
*Assistant Examiner*—Ephrem Alemu
(74) *Attorney, Agent, or Firm*—McKenna Long & Aldridge LLP

(57) ABSTRACT

A lamp apparatus for a liquid crystal display that is adaptive for providing a thin-thickness liquid crystal display. In the apparatus, a ground wire is commonly connected to low voltage electrodes of lamps. High voltage wires are connected, in series, to high voltage electrodes of the lamps. A first plug connects at least one of the high voltage wires and the ground wire. A second plug connects the other high voltage wires.

22 Claims, 8 Drawing Sheets

LAMP APPARATUS FOR LIQUID CRYSTAL DISPLAY DEVICE

This application claims the benefit of Korean Patent Application No. 2000-41530, filed on Jul. 20, 2000, which is hereby incorporated by reference.

BACKGROUND OF THE INVENTION

1. Field of the Invention

The present invention relates to a liquid crystal display, and more particularly to a lamp apparatus that is adaptive for providing a liquid crystal display having a thin thickness.

2 . Discussion of the Related Art

Generally, an active matrix liquid crystal display (LCD) uses a thin film transistor (TFT) as a switching device to display a moving picture. Since the LCD is able to provide a product having a smaller dimension than a Brown tube, it has been widely used in various applications of personal computer, notebook computer, office automation equipment such as copy machines, etc., and portable equipment such as personal data assistants and pagers, etc.

Such a LCD requires a backlight unit because it is not a self-emitting display device. The conventional backlight unit uses a lamp apparatus as a light source.

Referring to FIG. 1 and FIG. 2, the conventional lamp apparatus includes a plurality of lamps 22 received within a housing 26, ground wires 21 connected, in series, to low voltage electrodes 22*a* of the lamps 22 by virtue of a soldering, a first plug 24*a* connected to the ends of the ground wires 21, high voltage wires 23 connected, in series, to high voltage electrodes 22*b* of the lamps 22 by virtue of a soldering, and a second plug 24*b* connected to the ends of the high voltage wires 23. The first and second plugs 24*a* and 24*b* are connected to a low-voltage side jack and a high-voltage side jack of a power supply or an inverter (not shown), respectively. The ground wire 21 and the high voltage wire 23 apply a low voltage and a high voltage from the plugs 24*a* and 24*b* to both electrodes 22*a* and 22*b* of the lamp 22, respectively. Then, the lamp 22 causes a discharge accompanied by a light emission by a voltage difference of both electrodes 22*a* and 22*b*.

As shown in FIG. 3, the low voltage electrode 22*a* of the lamp 22 is connected to the ground wire 21 by the soldering 27. The connection between the low voltage electrode 22*a* of the lamp 22 and the ground wire is supported by a holder 25 engaged with the end of the housing 26.

In such a lamp apparatus, since the low voltage electrode 22*a* of the lamp 22 is connected to the ground wire 21 by soldering, a bubble is included in a cold solder, i.e., soldering causes a poor connection. Also, in the conventional lamp apparatus, since a length of the ground wire 21 is long, it is difficult to align the wires and to provide a slim-type design of the liquid crystal module. Furthermore, since the connectors 24*a* and 24*b* connected, in series, to the ground wire 21 and the high voltage wire 23 has the same structure, it is not easy to distinguish the connectors from each other when the connectors are inserted to a jack of the inverter.

SUMMARY OF THE INVENTION

Accordingly, the present invention is directed to a lamp apparatus for a liquid crystal display device that substantially obviates one or more of the problems due to limitations and disadvantages of the related art.

An object of the present invention is to provide a lamp apparatus that is adaptive for providing a thin-thickness liquid crystal display.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, a lamp apparatus for a liquid crystal display according to the present invention includes at least two lamps; a ground wire connected commonly to low voltage electrodes of the lamps; high voltage wires connected, in series, to high voltage electrodes of the lamps; a first plug for connecting at least one of the high voltage wires and the ground wire; and a second plug for connecting the other high voltage wires.

It is to be understood that both the foregoing general description and the following detailed description are exemplary and explanatory and are intended to provide further explanation of the invention as claimed.

BRIEF DESCRIPTION OF THE DRAWING

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiment of the present invention, example of which is illustrated in the accompanying drawings.

Figure 1:
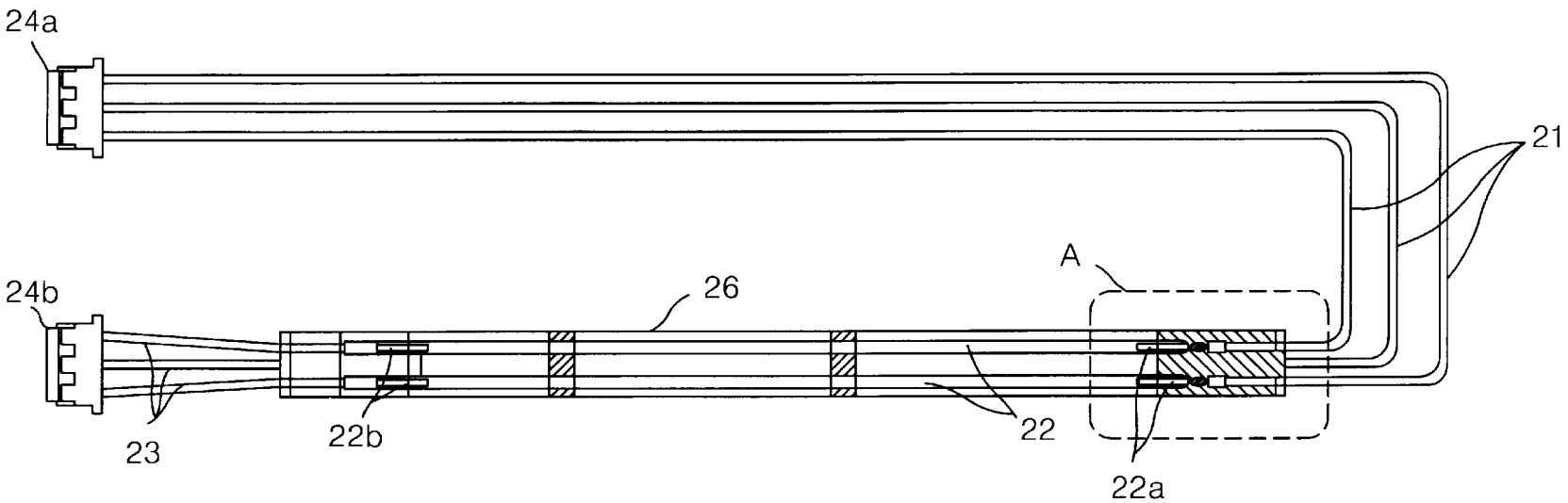
FIG. 1 PRIOR ART
FIG. 1 is a section view showing a structure of a housing assembly in a lamp apparatus of the conventional liquid crystal display.
Figure 2:
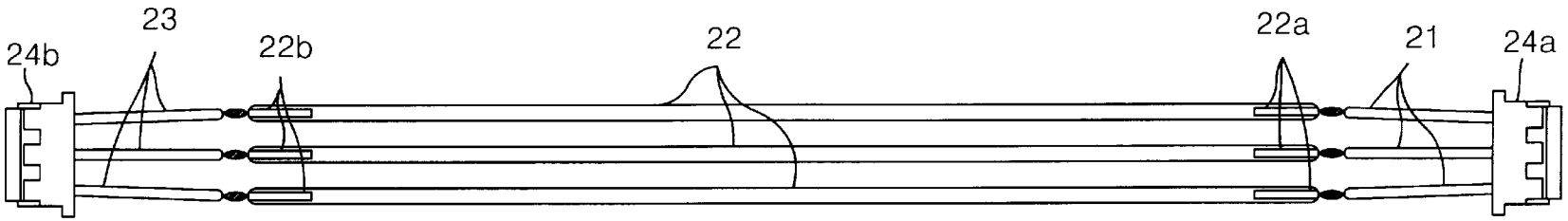
FIG. 2 PRIOR ART
FIG. 2 is a detailed section view separating the lamp assembly from the housing assembly in FIG. 1.
Figure 3:
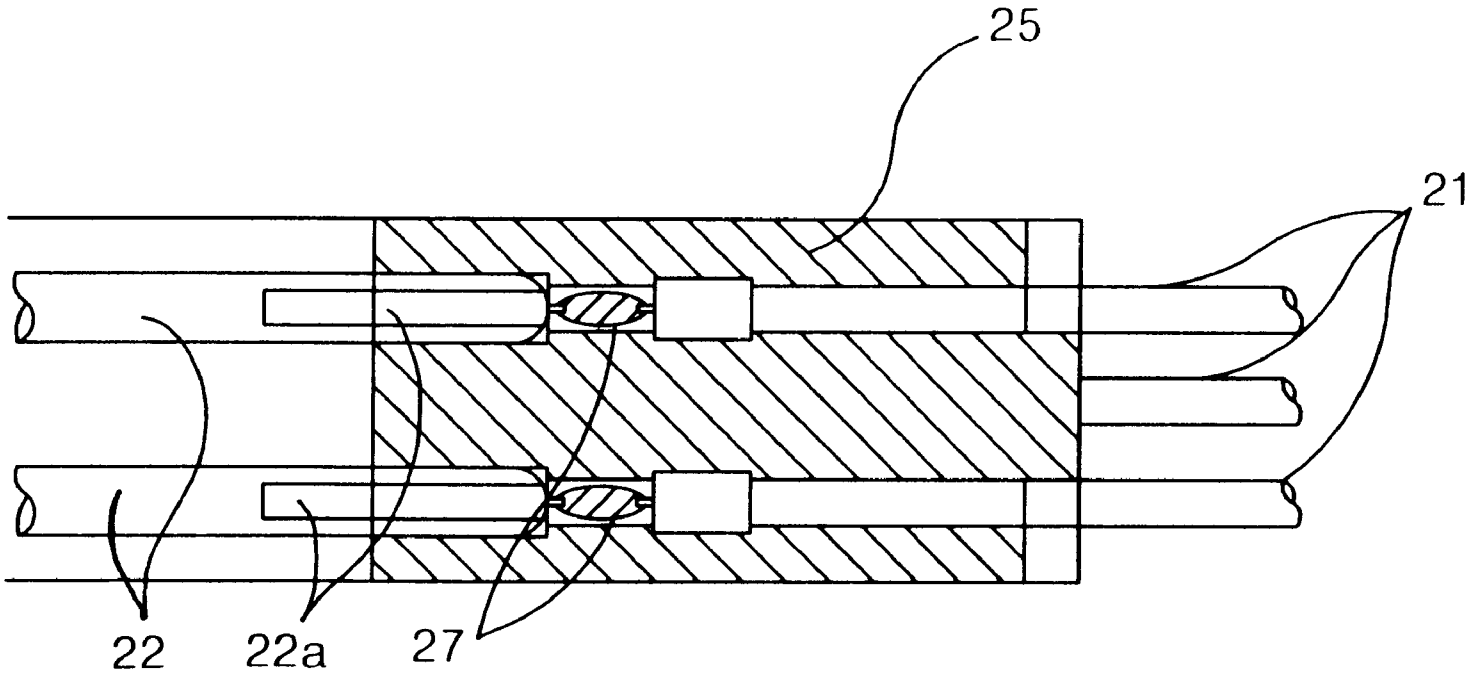
FIG. 3 PRIOR ART
FIG. 3 is an enlarged section view of the "A" portion of the housing assembly in FIG. 1.
Figure 4:
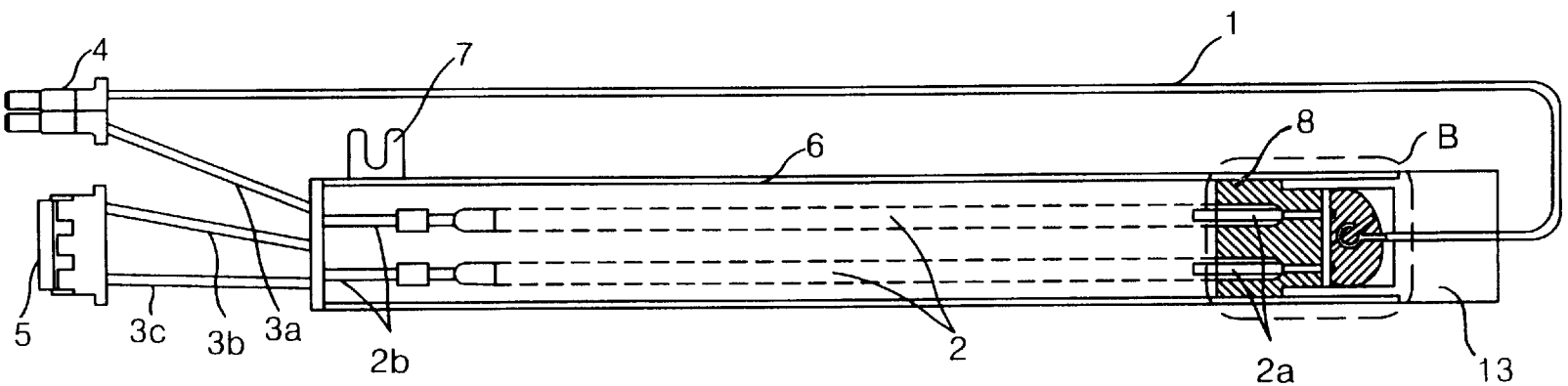
FIG. 4 is a section view showing a structure of a housing assembly in a lamp apparatus for a liquid crystal display according to an embodiment of the present invention.
Figure 5:
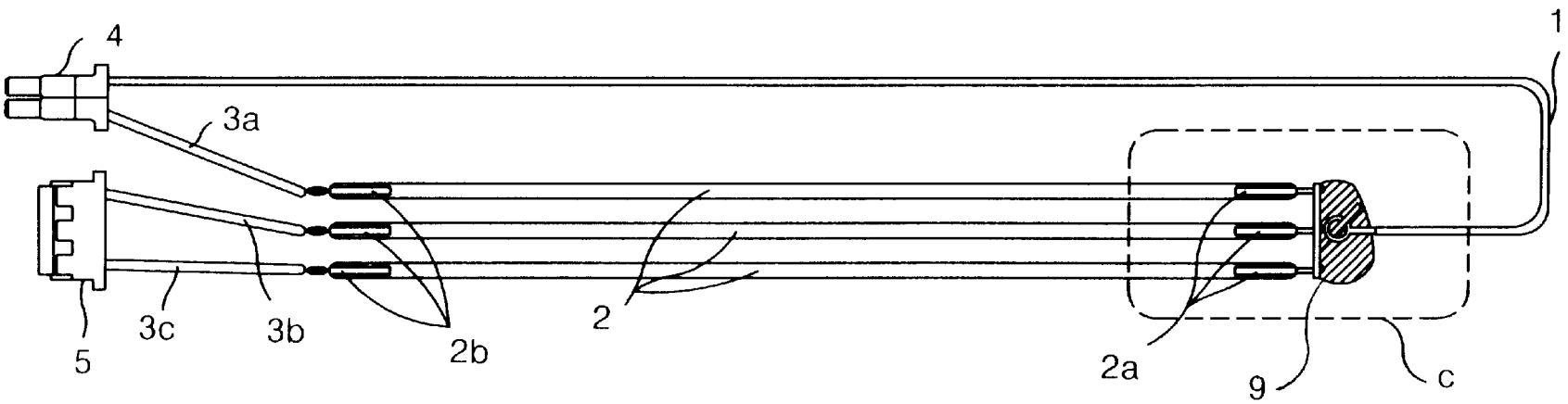
FIG. 5 is a detailed section view showing separation of the lamp assembly from the housing assembly in FIG. 4.
Figure 6:
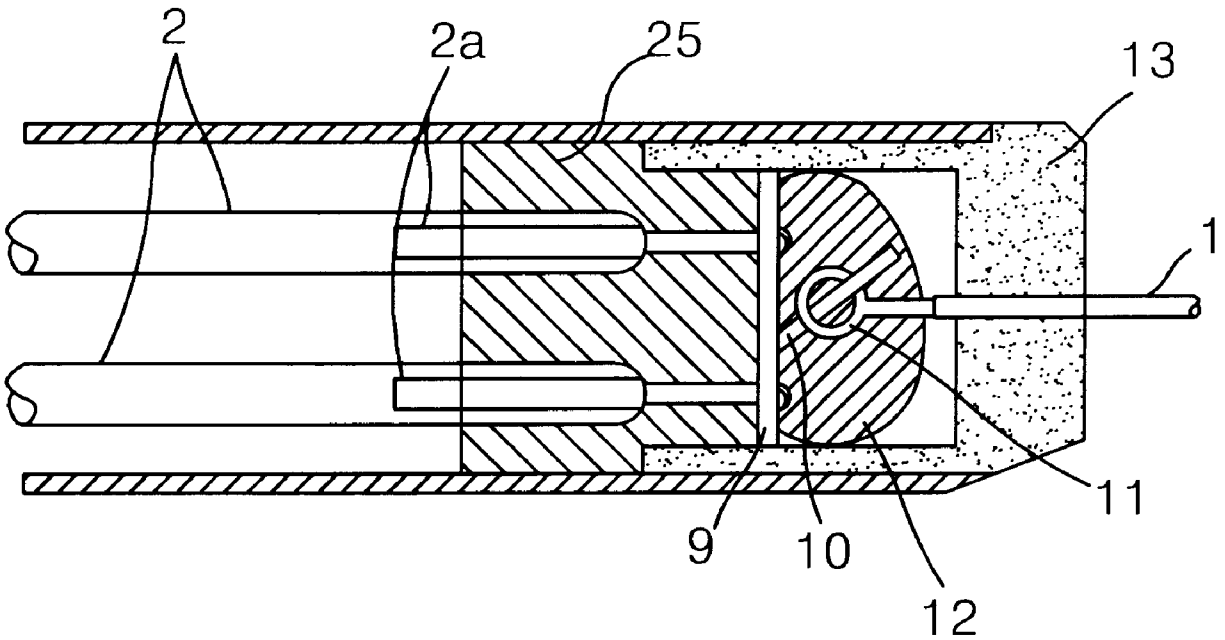
FIG. 6 is an enlarged section view of portion "B" of the housing assembly in FIG. 4.
Figure 7:
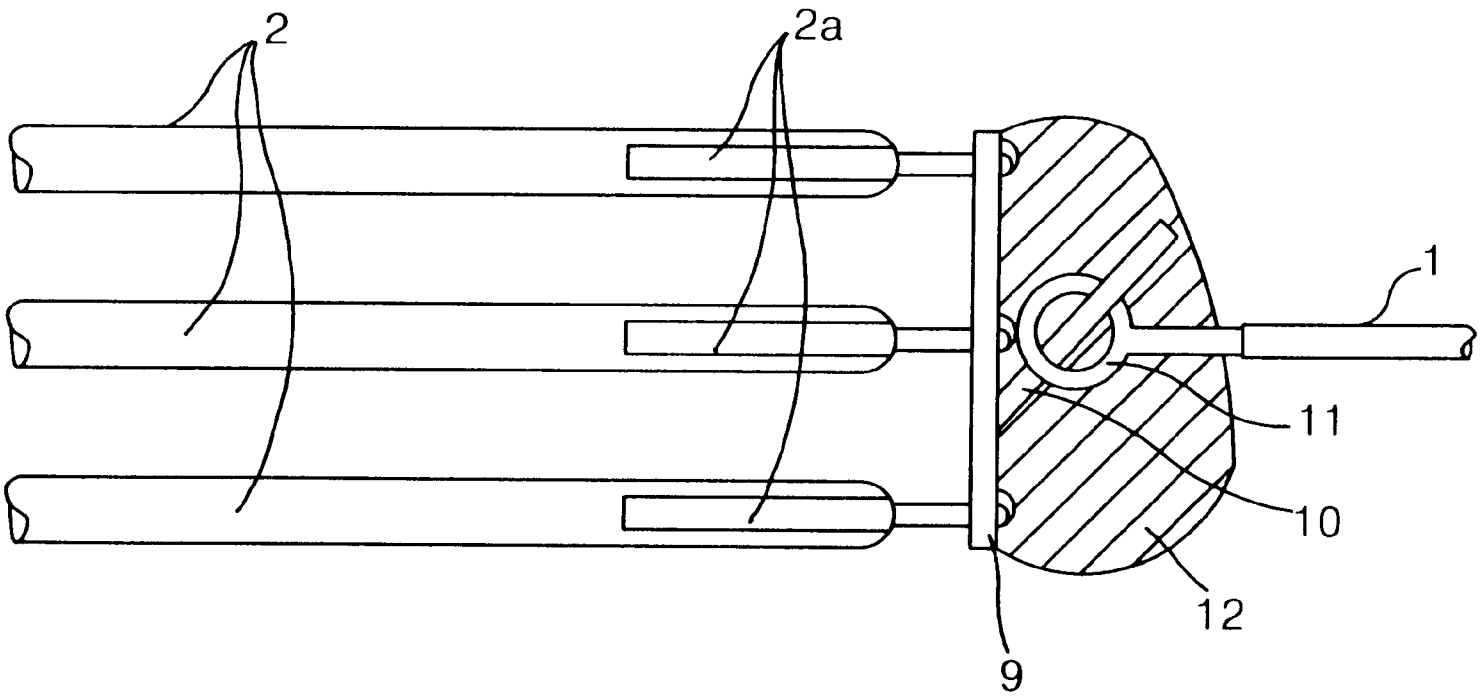
FIG. 7 is an enlarged section view of portion "C" of the lamp assembly in FIG. 5.

Referring to FIG. 4 and FIG. 5, there is shown a lamp apparatus for a liquid crystal display according to an embodiment of the present invention. The lamp apparatus includes a plurality of lamps 2 received within a housing 6, a ground wire 1 connected commonly to low voltage electrodes 2*a* of the lamps 2, high voltage wires 3*a*, 3*b* and 3*c* connected, in series, with high voltage electrodes 2*b* of the lamps 2; a first plug 4 connected to the ground wire 1 and the first high voltage wire 3*a*, and a second plug 5 connected to the second and third high voltage wires 3*b* and 3*c*. As shown in FIG. 6 and FIG. 7, the low voltage electrodes 2*a* of the lamps 2 are connected to the ground wire 1 via a ground plate 9, a clamp pin 10, a ring 11 and a soldering 12. More specifically, the low voltage electrodes 2*a* are commonly connected to the ground plate 9. The ground plate 9 is made from phosphorus bronze.

Figure 8:
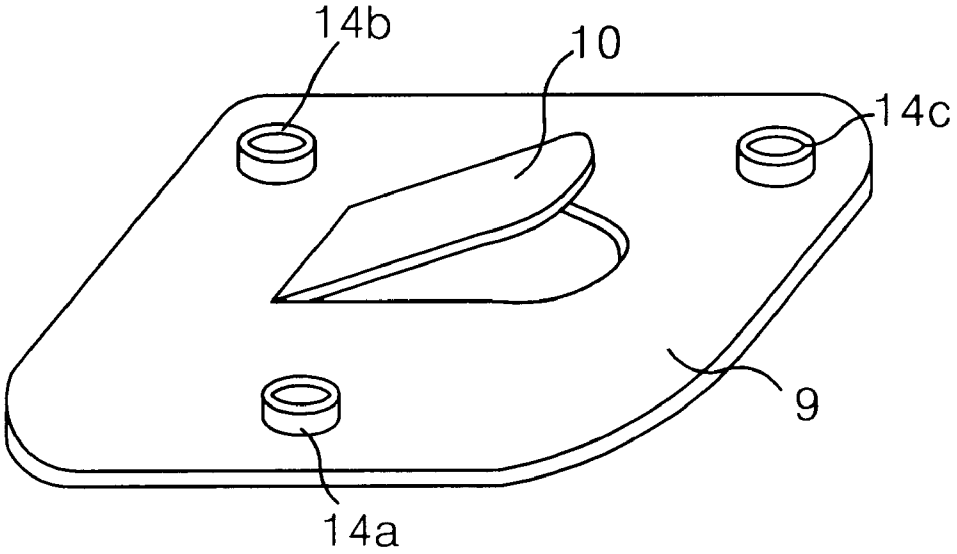
FIG. 8 is a detailed perspective view of the ground plate shown in FIG. 4.

As shown in FIG. 8, the clamp pin 10 is provided on the ground plate 9 by cutting the center of the ground plate 9 into an "U" shape and then bending the cut-away portion at a desired inclined angle (e.g., 30°). On the ground plate 9, bosses 14*a*, 14*b* and 14*c* are formed at three positions of the edge of the ground plate 9 with the clamp pin 10 therebetween. The low voltage electrodes 2*a* of the lamp 2 pass through the bosses 14*a*, 14*b* and 14*c*. The ground plate 9 may be replaced by a printed circuit board (PCB) made from an epoxy. In this case, the low voltage electrodes 2*a* are inserted into holes formed in the PCB and then secured to the rear side of the PCB by soldering. The ring 11 formed at the end of the ground wire 1 is inserted into the clamp pin 10. The connections of the low voltage electrodes 2*a* and the ground wire 1 connected electrically to each other in this manner are sealed by soldering 12, as shown in FIG. 6 and FIG. 7. The soldering 12 covers the ground plate 9, the clamp pin 10 and the ring 11. The ground wire 1 is connected to the first plug 4 which has two terminals. The first plug 4 is also connected with the first high voltage wire 3*a* which itself is connected to the high voltage electrode 2*b* of any one of the lamps. The second and third high voltage wires 3*b* and 3*c* are connected to the second plug 5, which has three terminals. A high voltage terminal of the first plug 4 is connected to a high voltage terminal of a first jack of a power supply or an inverter (not shown). A low voltage terminal of the first plug 4 is connected to a low voltage terminal of the first jack of a power supply or inverter. High voltage terminals of second plug 5 are connected to high-voltage terminals of a second jack which is different from the first jack of a power supply or an inverter (not shown). In this case, since the first and second plugs 4 and 5 have different structure, they can be accurately connected to the corresponding jacks. A ground plate 7 as shown in FIG. 4 is provided at the high voltage electrode side of the housing 6. This ground plate 7 is connected to a sash of the liquid crystal display module to ground the housing 6. At the low voltage electrode side of the housing 6, a holder 8 is engaged with a holder cap 13. The holder 8 keeps distance between the lamps 2 and supports the lamps 2 and the ground plate 9. The holder 8 is shielded with the holder cap 13. The ground wire 1 passes through the holder cap 13. The holder cap 13 secures the holder 8 to the ground wire 1.

As described above, in the lamp apparatus for a liquid crystal display according to the present invention, a single ground wire is commonly connected to a plurality of low voltage electrodes by virtue of the ground plate, the clamp pin, the ring and the soldering, and is connected to the first plug along with any one of the high voltage wires. Accordingly, the number of the ground wires is small and the wire alignment is easy, so that it becomes possible to provide a liquid crystal display having a thin thickness. Furthermore, because a single ground wire is commonly connected to a plurality of low voltage electrodes by virtue of the ground plate, the clamp pin, the ring and the soldering, it becomes possible to provide solid connections, as well as to minimize poor soldering. In addition, since the present lamp apparatus uses the two-terminal plug for connecting one ground wire and one high voltage wire and the three-terminal plug for connecting the other high voltage wires, it has an advantage that it is possible to distinguish the plugs easily when they are inserted to the jacks of the power supply or the inverter.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. A lamp apparatus for a liquid crystal display, comprising:

at least two lamps having low voltage and high voltage electrodes;

a ground wire connected commonly to the low voltage electrodes of the lamps;

high voltage wires connected, in series, to high voltage electrodes of the lamps;

a first plug for connecting at least one of the high voltage wires and the ground wire; and a second plug for connecting the other high voltage wires.

2. The lamp apparatus according to claim 1, further comprising:

a ground plate for electrically connecting the low voltage electrodes to each other;

a clamp pin protruded at a desired inclined angle from the ground plate; and a ring formed at the end of the ground wire.

3. The lamp apparatus according to claim 2, wherein the clamp pin is obliquely extended on the ground plate.

4. The lamp apparatus according to claim 3, wherein the clamp pin is inserted into the ring.

5. The lamp apparatus according to claim 2, wherein the ground plate, the clamp pin and the ring to which the low voltage electrodes are commonly connected is sealed by solder.

6. The lamp apparatus according to claim 2, wherein the ground plate is made from phosphorus bronze.

7. The lamp apparatus according to claim 1, wherein the ground plate is a printed circuit board.

8. The lamp apparatus according to claim 1, wherein the first plug has a first number of terminals and second plug has a second number of terminals, wherein the first number and the second number are not equal.

9. The lamp apparatus according to claim 8, wherein the first plug has two terminals and the second plug has three terminals.

10. The lamp apparatus according to claim 2, further comprising:

a lamp housing;

a holder installed at the housing to support the lamps and the ground plate; and a holder cap at the housing the holder to pass the ground wire therethrough for securing the holder to the ground wire.

11. A lamp apparatus for a liquid crystal display, comprising:

a plurality of lamps having low voltage and high voltage electrodes;

a ground wire connected in parallel to the low voltage electrodes of the lamps;

high voltage wires connected in series to high voltage electrodes of the lamps;

a first plug for connecting at least one of the high voltage wires and the ground wire;

a second plug for connecting the other high voltage wires;

wherein the low voltage electrodes are electrically connected to a ground plate and the ground plate is electrically connected to the ground wire.

12. The lamp apparatus according to claim 11, wherein the ground plate further comprises:

a clamp pin protruded at a desired inclined angle from the ground plate; and a plurality of bosses formed in the ground plate;

wherein the low voltage electrodes pass through the plurality of bosses.

13. The lamp apparatus according to claim 12, wherein the ground wire further comprises:

a ring formed end of the ground wire;

wherein the ring is inserted into the clamp pin.

14. The lamp apparatus according to claim 12, wherein the clamp pin is obliquely extended on the ground plate.

15. The lamp apparatus according to claim 13, wherein the clamp pin is electrically connected to a ring.

16. The lamp apparatus according to claim 13, wherein the ground plate, the clamp pin and the ring to which the low voltage electrodes are commonly connected is sealed by solder.

17. The lamp apparatus according to claim 12, wherein the ground plate is made from phosphorus bronze.

18. The lamp apparatus according to claim 12, wherein the ground plate is a printed circuit board.

19. The lamp apparatus according to claim 11, wherein the first plug has a first number of terminals and second plug has a second number of terminals, wherein the first number and the second number are not equal.

20. The lamp apparatus according to claim 11, wherein the first plug has two terminals and the second plug has three terminals.

21. The lamp apparatus according to claim 11, further comprising:

a lamp housing;

a holder installed at the lamp housing to support the plurality of lamps and the ground plate; and a holder cap at the lamp housing to pass the ground wire therethrough for securing the holder to the ground wire.

22. The lamp apparatus according to claim 11, wherein the first plug has two terminals, and the second plug has three terminals connected to at least one of a power supply and an inverter.

* * * * *